US007344351B2

(12) United States Patent
Rokusek et al.

(10) Patent No.: US 7,344,351 B2
(45) Date of Patent: Mar. 18, 2008

(54) ELECTRONIC BOOM HEIGHT SENSOR

(75) Inventors: Richard Gary Rokusek, Dubuque, IA (US); Gregory Keith Werner, Durango, IA (US); Scott Joseph Breiner, Dubuque, IA (US); Daniel Lawrence Pflieger, East Dubuque, IL (US)

(73) Assignee: Deere & Company, Moline, IL (US)

( * ) Notice: Subject to any disclaimer, the term of this patent is extended or adjusted under 35 U.S.C. 154(b) by 506 days.

(21) Appl. No.: 10/661,166

(22) Filed: Sep. 12, 2003

(65) Prior Publication Data

US 2005/0058530 A1 Mar. 17, 2005

(51) Int. Cl.
*B66C 23/00* (2006.01)

(52) U.S. Cl. ..... 414/699; 74/532; 338/170; 700/213

(58) Field of Classification Search ..... 414/299, 414/680, 685, 408; 701/50; 700/213; 74/532; 172/2; 338/167, 169, 170; 212/278
See application file for complete search history.

(56) References Cited

U.S. PATENT DOCUMENTS

| | | | | |
|---|---|---|---|---|
| 3,429,471 A | | 2/1969 | Austin et al. | |
| 3,489,294 A | * | 1/1970 | Greb et al. | 212/278 |
| 3,754,665 A | * | 8/1973 | Eiler | 212/278 |
| 4,135,632 A | * | 1/1979 | Berkel, Jr. | 414/698 |
| 4,499,541 A | | 2/1985 | Miyazaki et al. | 364/424 |
| 4,917,565 A | | 4/1990 | Kourogi | |
| 5,538,149 A | | 7/1996 | Martin | 212/278 |
| 6,158,945 A | * | 12/2000 | Anderson et al. | 414/408 |
| 6,533,076 B1 | | 3/2003 | Trego et al. | 187/394 |

FOREIGN PATENT DOCUMENTS

| | | |
|---|---|---|
| DE | 41 10 959 | 10/1991 |
| EP | 0 718 593 | 6/1996 |
| EP | 1 258 450 | 11/2002 |
| JP | 2000-129731 | 5/2000 |

* cited by examiner

*Primary Examiner*—Donald Underwood

(57) ABSTRACT

A boom position detecting device that detects a boom angle on a work vehicle for a boom that rotates about a pivot. The device includes a boom angle follower and positional sensor. The boom angle follower includes a spring and a follower arm arranged such that the spring biases the follower arm against a surface of the boom and keeps the follower arm in contact with the boom throughout a rotational movement of the boom about the pivot. The positional sensor is physically connected to the boom angle follower and detects at least one boom angle.

13 Claims, 7 Drawing Sheets

ELECTRONIC BOOM HEIGHT SENSOR

FIELD OF THE INVENTION

The invention relates to boom operation on work vehicles such as, for example, loaders. It relates to a simple and inexpensive system and method of improving the safety, comfort, accuracy and repeatability/consistency in boom operation.

BACKGROUND OF THE INVENTION

On many work vehicles such as, for example, loaders and backhoes, the heights and angles of the work tools must be visually estimated and manually adjusted on a somewhat constant basis. This will quickly lead to fatigue for a normal human operator. On other work vehicles, a few positions, i.e., heights and angles, of the work tools are factory preset allowing the work tools to be automatically placed in those positions at the direction of the operator via a simple pushing of a button, a manipulation of a handle or some other simple operation. On still other work vehicles, kickout positions for the work tools may be programmed and modified by the vehicle operators from without or within the cab. However, the adjustment methods and/or mechanisms appear to be complex, cumbersome and/or expensive as they require sensor systems with complex linkages and/or adjustments by vehicle operators outside of the operator cab.

SUMMARY OF THE INVENTION

The inventors recognize that conventional boom height sensing and adjustment mechanisms are somewhat cumbersome and/or expensive and have determined that such is unnecessary. They have invented a simplified method of tracking the position of a boom for a work vehicle. The method uses a height or angle sensor of very simple design which comprises a spring loaded follower arm biased such to constantly exert pressure against the boom at all boom positions. Thus, the follower arm rotates as the position of the boom changes and causes a change in electrical potential across an electromechanical device such as, for example, a potentiometer. This change in electrical potential is fed to a signal processing device or onboard computer such as, for example, a chassis control unit and the operator. After electronically sensing the boom position, it is possible to set kickout positions, return to dig positions and/or return to carry positions from the cab with a mere push of a button or operation of a switch at desired boom heights. A boom manipulating control lever, used by the operator to manipulate the boom from within the cab normally has at least one detent or locked position. The boom may be automatically set to move to a set/stored position by moving the control lever to the detent position. Once the boom reaches the position associated with the stored signal the chassis control unit sends a signal to release the control lever from the detent position and allows it to return to a neutral position. Thus, the movement of the boom stops upon release of the control lever.

The system is extremely simplified and does not require a linkage system between the sensor and the boom as in conventional systems. Thus, the sensor is capable of being attached with a minimum of modifications to the work vehicle as it is merely rigidly affixed to a portion of the vehicle and connected via electrical cable or wirelessly to the height estimating device. Conveying the position data to the chassis control unit may be accomplished through a flexible electrical cable or wirelessly via electromagnetic waves.

BRIEF DESCRIPTION OF THE DRAWINGS

Embodiments of the invention will be described in detail, with reference to the following figures, wherein.

DETAILED DESCRIPTION

Figure 1:
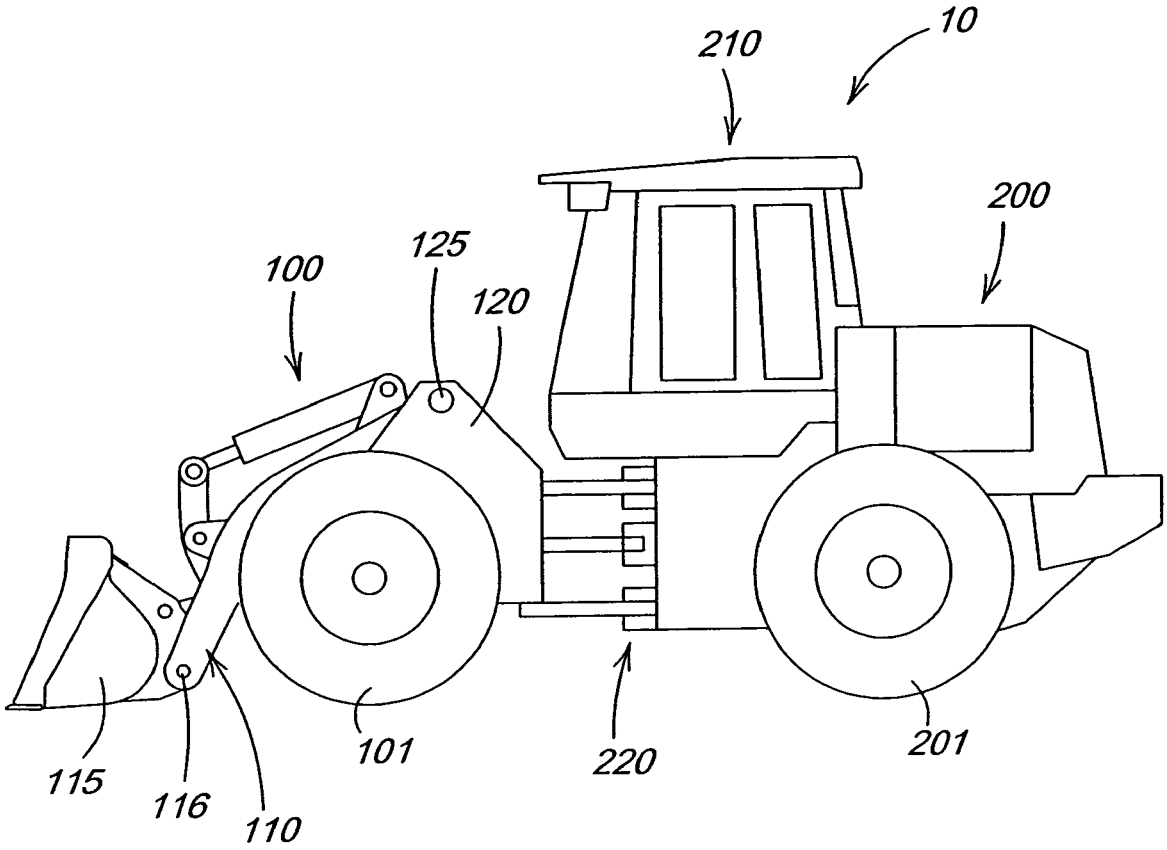
FIG. 1 is view of a work vehicle in which the invention may be used.

FIG. 1 illustrates a work vehicle in which the invention may be used. The particular work vehicle illustrated in FIG. 1 is an articulated four wheel drive loader having a main vehicle body 10 that includes a front vehicle portion 100 pivotally connected to a rear vehicle portion 200 by vertical pivots 220, the loader being steered by pivoting of the front vehicle portion 100 relative to the rear vehicle portion 200 in a manner well known in the art. The front and rear vehicle portions 100 and 200 are respectively supported on front drive wheels 101 and rear drive wheels 201. An operator's station 210 is provided on the rear vehicle portion 200 and is generally located above the vertical pivots 220. The front vehicle portion 100 includes a mast 120. The front and rear drive wheels 101 and 201 propel the vehicle along the ground and are powered in a manner well known in the art.

Mounted on the front vehicle portion 100 is a boom 110. The rear end of the boom 110 is connected to the mast 120 by transverse pivots 125 and a loader bucket 115 is mounted on the forward end of the boom 110 by transverse pivots 116. The boom 110 is rotated about the transverse pivots 125 by hydraulic lift cylinders (not shown).

Figure 2:
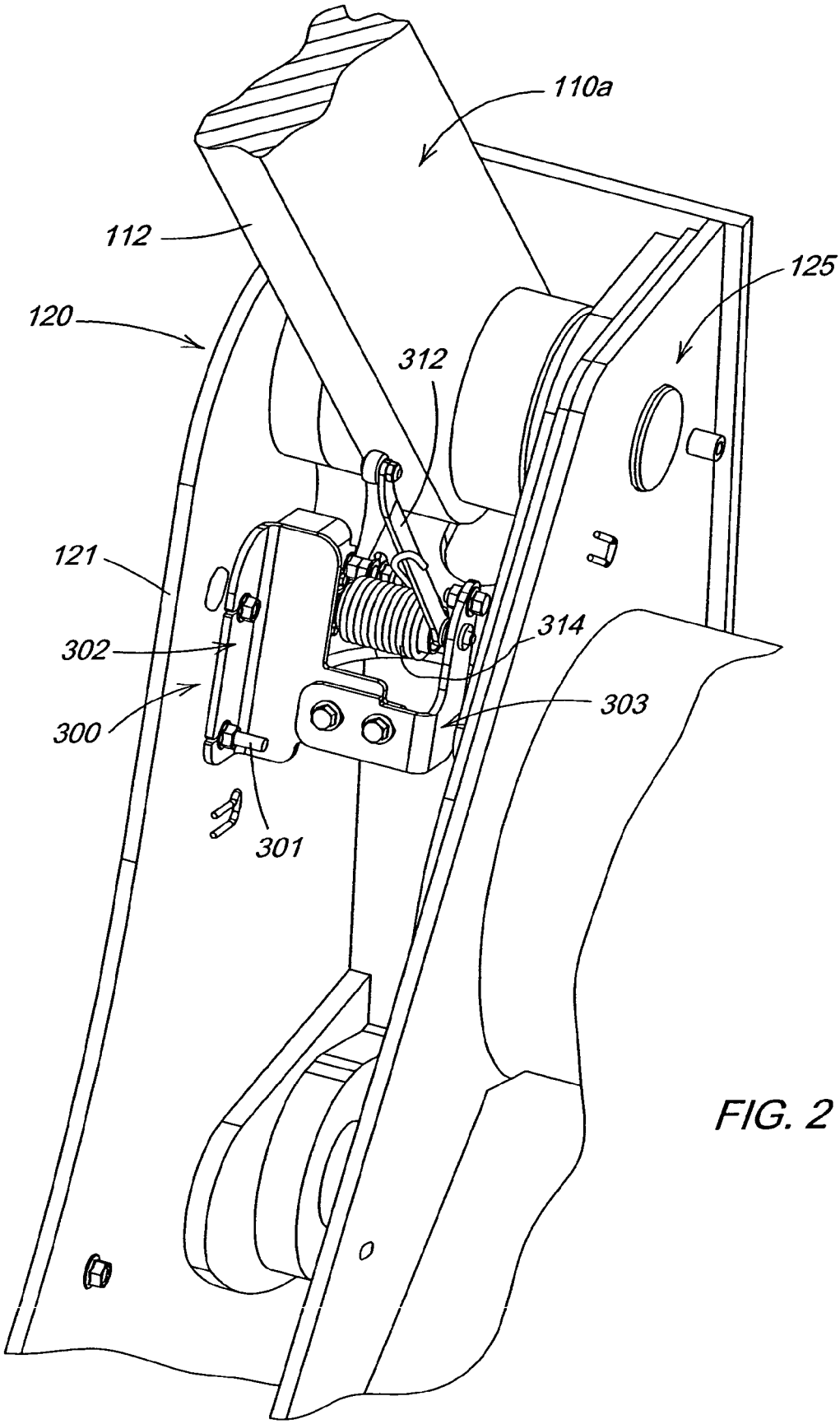
FIG. 2 is an oblique view of an exemplary embodiment of the assembled invention showing the boom in a heightened or kickout position.
Figure 3:
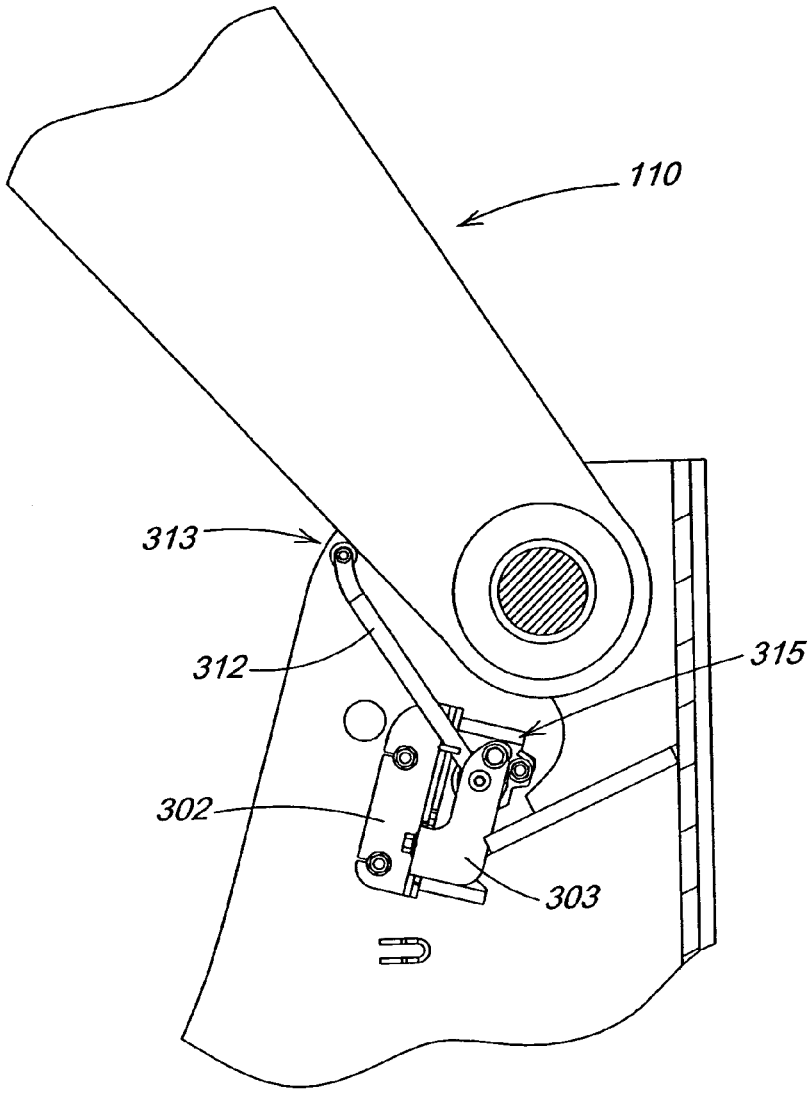
FIG. 3 is a side view of the embodiment illustrated in FIG. 2.
Figure 4:
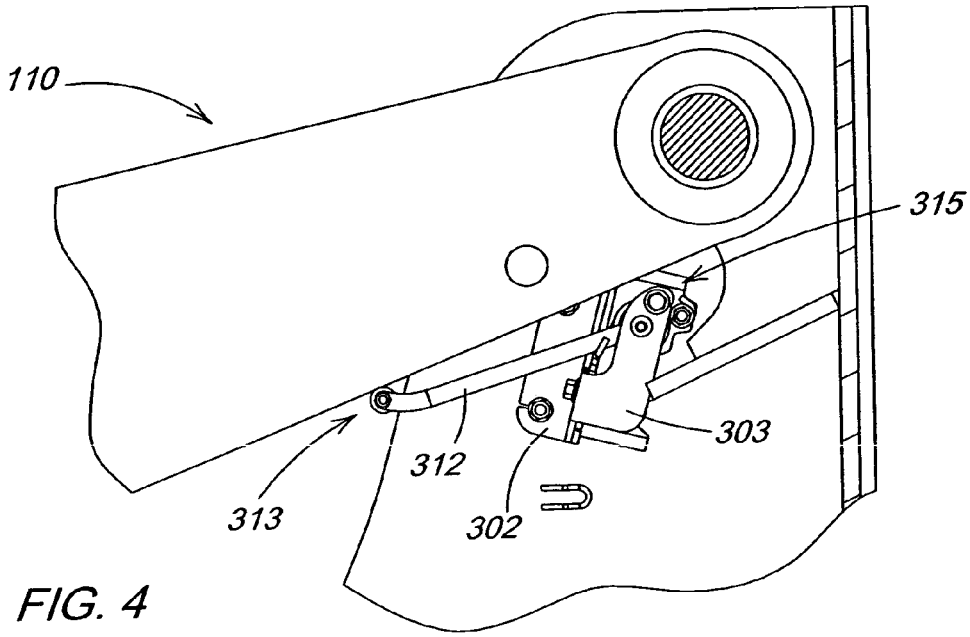
FIG. 4 is a side view of an exemplary embodiment of the assembled invention showing the boom in a lowered or return position.

FIG. 2 illustrates an exemplary embodiment of a boom position sensing device 300 of the invention mounted to the mast 120. In this particular embodiment, the sensing device 300 is mounted to a side wall 121 of the mast 120 via screws 301. In this particular embodiment, a spring loaded follower arm 312 is biased against the underside of the boom 110 such that the follower arm 312 exerts pressure against the boom 110 at all rotational locations. Thus, as shown in FIG. 3 and FIG. 4, the spring loaded follower arm 312 of this embodiment contacts the underside of the boom 110 at all points of rotation for the boom 110 without the necessity of a physical attachment to the boom 110 and the accompanying complexities associated with such an attachment.

Figure 5:
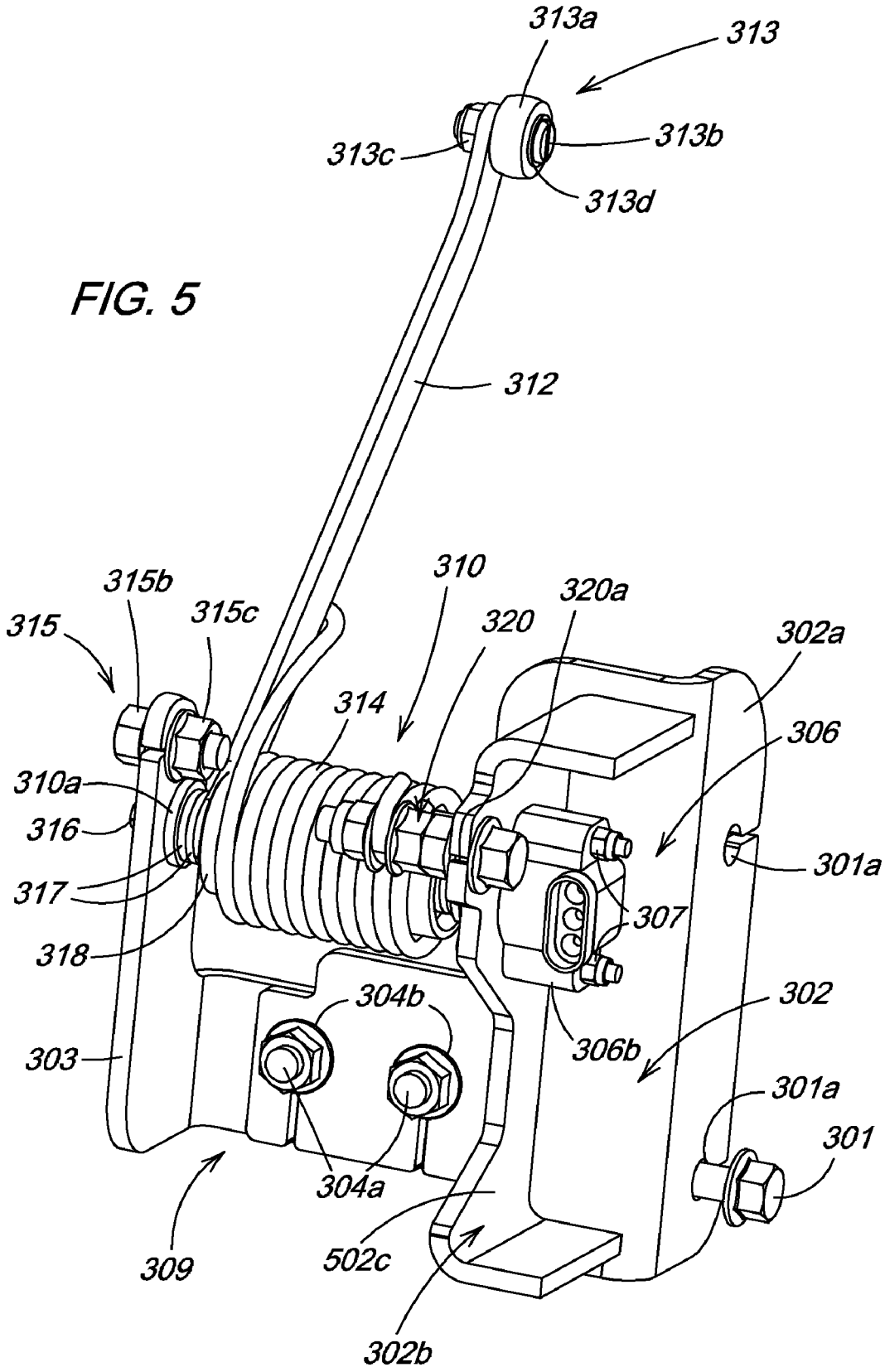
FIG. 5 is a rearward view of the sensor.
Figure 6:
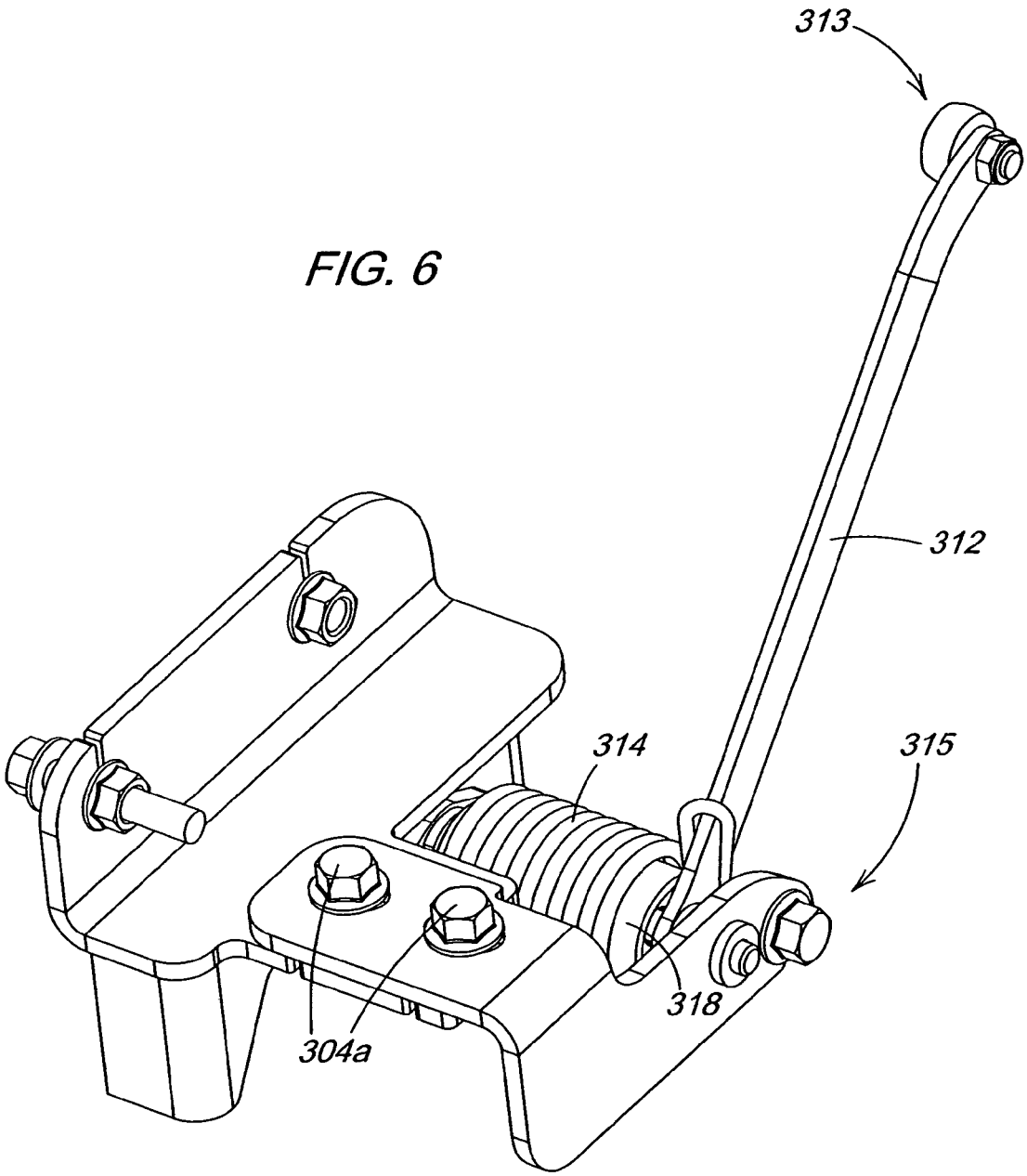
FIG. 6 is a frontal view of the sensor.
Figure 7:
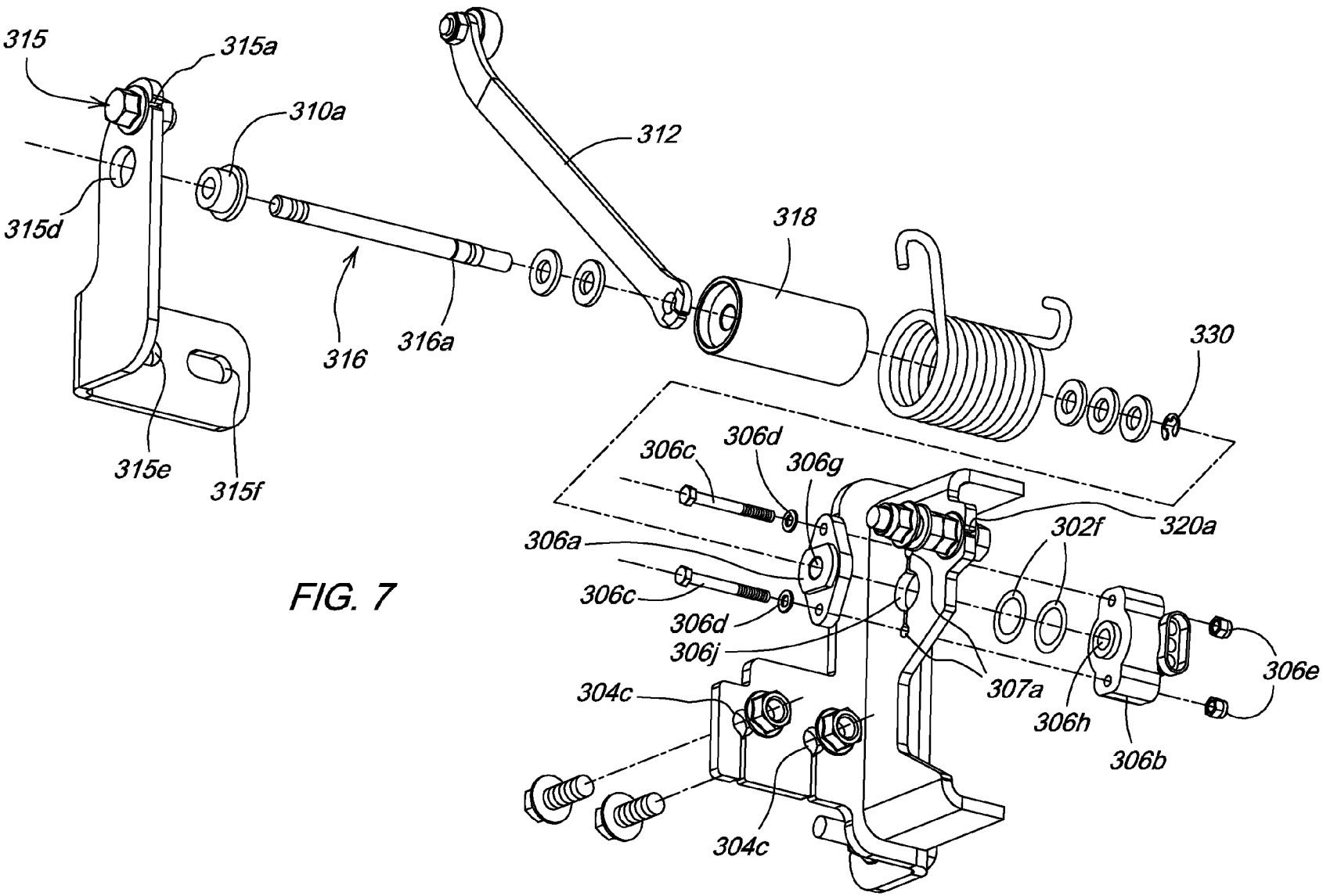
FIG. 7 is an exploded view of the sensor.

FIG. 5 illustrates an exemplary embodiment of the boom position sensing device 300 of the invention. As shown in FIG. 5, the boom position sensing device 300 includes a body 309, a follower assembly 310 and a potentiometer assembly 306.

The body 309 includes a first body portion 302 and a second body portion 303, the first and second body portions 302 and 303 being rigidly connected to each other via bolts 304*a* and locknuts 304*b*. The first body portion 302 includes a L channel portion 302*a* and a C channel portion 302*b*. The L channel portion 302*a* contains two holes 301*a* for attaching the entire boom position sensing device 300 to the outer wall 121 of the mast 120 via bolts 301. It also contains two holes 304*c* for attaching the first body portion 302 to the second body portion 303 via bolts 304*a* and locknuts 304*b*. The C channel portion 302*b* contains two holes 307*a* for attaching a potentiometer assembly 306 via locknuts 306*e* and bolts 306*c* and a third hole 306*j* to allow the passage of shaft 316 through the wall of the C channel portion 302*b* and into the potentiometer 306*b*. Finally, the C channel portion 302*b* contains an anchor bolt hole 320*a* for attaching a spring anchor bolt subassembly 320.

The second body portion 303 contains two holes 315*e*, 315*f* for attaching the first body portion 302 to the second body portion 303. The second body portion 303 also contains two additional holes 315*a* and 315*d*. Attached to the second body portion at holes 315*a*, 315*d*, is a stop assembly 315 to restrict rotational motion on the follower arm 312. Press fitted into the hole 316*a* and toward a first end of a shaft 316 of the follower assembly 310 is a shaft bushing 310*a* to enhance rotational movement of the shaft and to restrict axial movement of the spring bushing 318. Washers 317 are placed along the shaft 316 on either side of the spring bushing 318, a first end of the follower arm 312 is press fitted onto the shaft at a position next to the spring bushing 318, and a snap ring is assembled to a snap ring groove 316*a* toward a second end of the shaft 316 to hold all of the washers 317 and the spring bushing 318 in place as well as to restrict axial movement of the shaft 316. A first end of torsional loading spring 314 is anchored to spring anchor 320 while a second end of torsional loading spring 314 constrains and biases the follower arm 312 against the underside of the first boom arm 110*a*. Attached to a second end of the follower arm 312 is a roller assembly 313 which includes a roller wheel 313*a* and bushing 313*d* as well as a roller bolt 313*b* and a locknut 313*c* to restrict all motion of the roller wheel 313*a* and the bushing 313*d* relative to the roller bolt 313*b* excepting rotational motion.

The follower assembly 310 includes the follower arm 312, the torsional spring 314, the shaft 316, the shaft bushing 310*a*, the plurality of spacers 317, the snap ring 330, and the spring bushing 318.

Attached to the C channel portion 302*b* is a sensor or potentiometer assembly 306 which includes a bracket portion 306*a* and a sensor portion or potentiometer 306*b*. The bracket portion 306*a* and the potentiometer 306*b* are attached to opposite sides of a C channel wall 302*c* via bolts 306*c*, washers 306*d* and locknuts 306*e*. On assembly of the potentiometer assembly 306, rubber washers 302*f* are placed between the C channel wall 302*c* and the potentiometer 306*b* as a seal against the environment. On assembly of the entire boom height sensing device 300 the second end of the shaft 316 protrudes through a hole 306*g* in the bracket portion 306*a* and into a hole 306*h* in the potentiometer 306*b* where it is keyed in a well known manner to a conventional rotor in the potentiometer 306*b* such that a change in the angle of the shaft 316 results in a proportional change in the potential across the potentiometer 306*b*.

Figure 8:
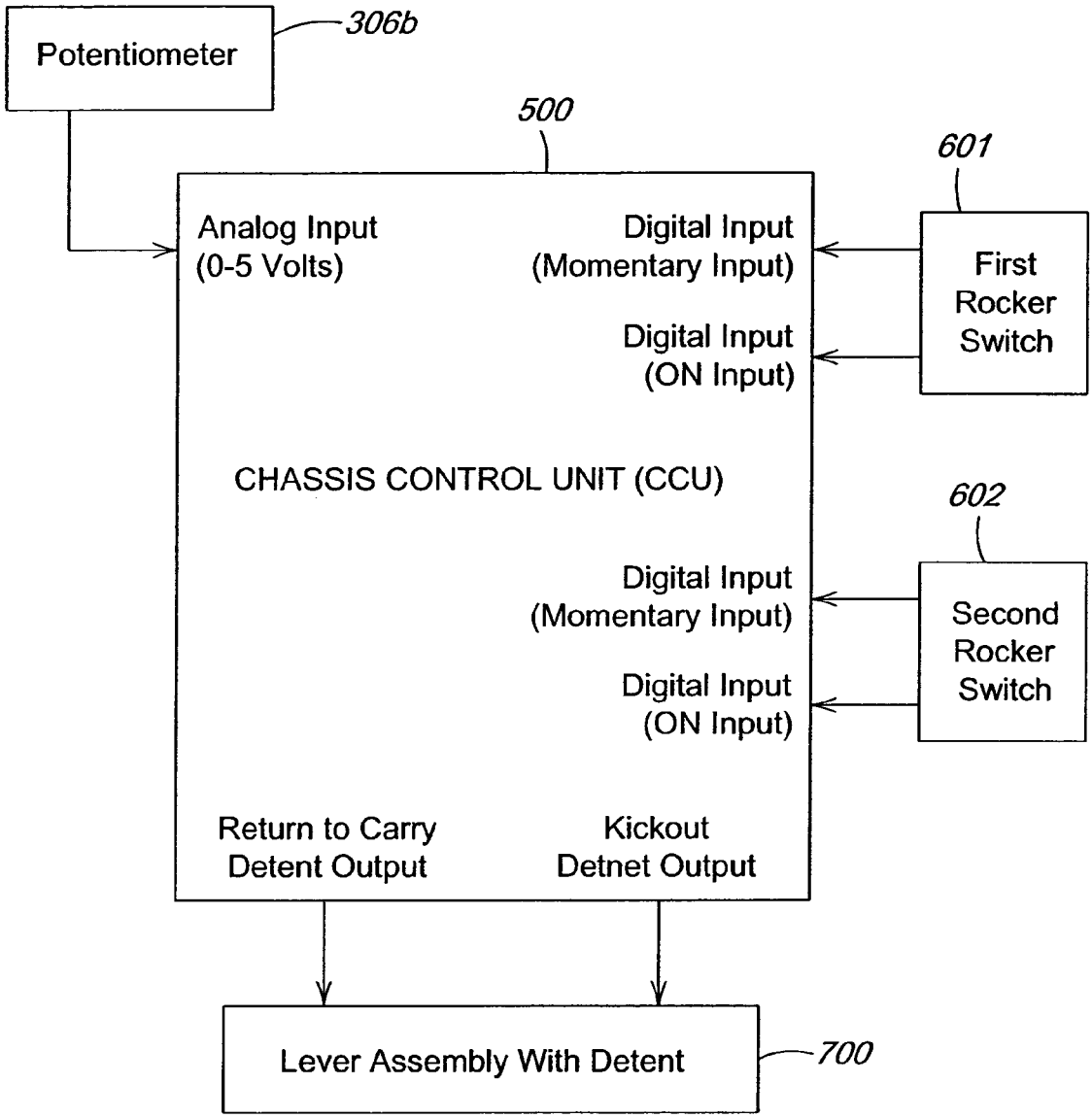
FIG. 8 is an exemplary embodiment of a functional diagram of the invention.

As illustrated in FIG. 8, the detected signal from the boom position detector 300 is transmitted to the chassis control unit 500 via electrical wire or wirelessly through electromagnetic waves. The first rocker switch 601 and the second rocker switch 602 are activated with a push. Subsequent to activation, the operation of the first rocker switch 601 and/or the second rocker switch 602 sends a momentary signal to the chassis control unit 500 which causes the chassis control unit 500 to record the current signal value from the boom position detector 300. The chassis control unit 500 then compares the recorded signal to the detected signal from the boom position detector 300 and sends a signal to unlock the control lever 700 from the detent position when the recorded signal is approximately equal to the detected signal. The chassis control unit 500 is capable of storing additional detected signal values, i.e., after storing a value for the first rocker switch 601, it may store an additional value for the second rocker switch 602. Thus, boom kickout values and return to carry values may coexist in the chassis control unit increasing the convenience and ease of operation of the work vehicle.

Having described the illustrated embodiment, it will become apparent that various modifications can be made without departing from the scope of the invention as defined in the accompanying claims. For example, it is possible for a dial in potentiometer or a digital device with a position readout to be calibrated to the potentiometer 306*b* such that the position could be dialed or typed in by the operator prior to placing the boom in that position.

The invention claimed is:

1. A height setting system for automatically adjusting a boom position on a work vehicle, the work vehicle including a cab, a mast, a boom pivotally connected to the mast, a power device capable of moving the boom about the mast, a work tool connected to a free portion of the boom, and a boom manipulating lever operatively connected to the power device, the lever having at least one detent position, the boom including a boom arm, the system comprising:

a boom position sensor, the boom position sensor including a spring, a follower arm and a positional sensor, the spring capable of biasing the follower arm against a surface of the boom such that the follower arm contacts and follows the boom through a rotational movement of the boom, the positional sensor detecting at least one boom position;

a detent release mechanism capable of releasing the lever from the at least one detent position; and an automatic boom position adjustment device connected to the positional sensor and operatively connected to the detent release mechanism, the automatic boom adjustment device including a switch, the switch locatable in the cab, the automatic boom position adjustment device creating at least one recorded position by recording the at least one boom position detected by the boom position sensor at an operation of the switch, the automatic boom position adjustment device moving the boom to the at least one recorded position when the lever is placed in the at least one detent position by releasing the lever, via the detent release mechanism, when the at least one recorded position is deteced via the positional sensor.

2. The height setting system of claim 1, wherein the positional sensor is electronic.

3. The height setting system of claim 1, wherein the positional sensor is a potentiometer.

4. The height setting system of claim 1, wherein the power device is a hydraulic cylinder.

5. The height setting system of claim 1, wherein the at least one detent position includes a first detent position and a second detent position and the at least one recorded position includes a first recorded position and a second recorded position.

6. The height setting system of claim 5, wherein the automatic boom position adjustment device moves the boom to one of the first and the second recorded positions when the lever is placed in one of the first and the second detent positions.

7. The height setting system of claim 1, wherein the automatic boom position adjustment device includes a conventional on-board computer and a detent release mechanism electronically connected to the on-board computer, the detent release mechanism releasing the lever from the at least one detent position upon receiving a signal from the on-board computer.

8. The height setting system of claim 7, wherein the automatic boom position adjustment device contains data giving a distance from a rotational center of the boom to the work tool and calculates a height of the work tool based on an angle of the boom and the distance from the rotational center of the boom to the work tool.

9. The height setting system of claim 8, wherein the automatic boom position adjustment device comprises a data entry portion for a numerical entry of the height of the work tool.

10. The height setting system of claim 9, wherein the automatic boom position adjustment device calculates and records a detected boom position based on the numerical entry.

11. The height setting system of claim 9, wherein the data entry portion comprises a keyboard and a viewing screen that displays at least one of the numerical entries and the at least one recorded position.

12. A work vehicle for performing a work operation, the work vehicle comprising:

a frame;

ground engaging means for supporting and propelling the frame;

a mast extending upwardly from the frame;

a boom having a first boom end and a second boom end, the first boom end pivotally coupled to the mast;

a power device capable of moving the boom about the mast;

a boom manipulating lever operatively connected to the power device, the lever having at least one detent position;

a detent release mechanism capable of releasing the lever from the at least one detent position;

a work tool operatively coupled to the second boom end; and a height setting system for automatically adjusting a boom position on the work vehicle, the system including:

a boom position detecting device, the boom position detecting device including a spring, a follower arm and a positional sensor, the spring biasing the follower arm against a surface of the boom such that the follower arm contacts and follows the boom through a rotational movement of the boom, the positional sensor detecting at least one boom position; and an automatic boom position adjustment device connected to the positional sensor and operatively connected to the detent release mechanism, the automatic boom adjustment device including a switch, the automatic boom position adjustment device creating at least one recorded position by recording the at least one boom position detected by the boom position detecting device upon operation of the switch, the automatic boom position adjustment device moving the boom to the at least one recorded position when the lever is placed in the at least one detent position by releasing the lever via the detent release mechanism when the at least one recorded position is detected via the boom position detection device.

13. The work vehicle of claim 12, wherein the at least one recorded position includes multiple recorded positions.

* * * * *